US009037040B2

(12) United States Patent
Murata

(10) Patent No.: US 9,037,040 B2
(45) Date of Patent: May 19, 2015

(54) IMAGE FORMING APPARATUS AND TONER CASE

(71) Applicant: KYOCERA Document Solutions Inc., Osaka (JP)

(72) Inventor: Koji Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/313,830

(22) Filed: Jun. 24, 2014

(65) Prior Publication Data

US 2015/0003870 A1 Jan. 1, 2015

(30) Foreign Application Priority Data

Jun. 28, 2013 (JP) ..... 2013-135733

(51) Int. Cl.
*G03G 21/16* (2006.01)

(52) U.S. Cl.
CPC ..... *G03G 21/1676* (2013.01)

(58) Field of Classification Search
CPC combination set(s) only.
See application file for complete search history.

(56) References Cited

FOREIGN PATENT DOCUMENTS

| | | | |
|---|---|---|---|
| JP | H08-114976 | A | 5/1996 |
| JP | 2008-197595 | A | 8/2008 |
| JP | 2008-261968 | A | 10/2008 |

*Primary Examiner* — Clayton E Laballe
*Assistant Examiner* — Jas Sanghera
(74) *Attorney, Agent, or Firm* — Studebaker & Brackett PC

(57) ABSTRACT

An image forming apparatus includes a toner case, a first attached part and a second attached part. The toner case is attachable and detachable to the first attached part and the second attached part. The toner case includes a moving member and driving member. The moving member is capable of moving between a replenishing position and a collecting position. The driving member moves the moving member from the replenishing position to the collecting position with at least one of the attachment of the toner case to the first attached part and detachment of the toner case from the first attached part.

18 Claims, 11 Drawing Sheets

IMAGE FORMING APPARATUS AND TONER CASE

INCORPORATION BY REFERENCE

This application is based on and claims the benefit of priority from Japanese Patent application No. 2013-135733 filed on Jun. 28, 2013, the entire contents of which are incorporated herein by reference.

BACKGROUND

The present disclosure relates to an electrographic image forming apparatus and a toner case provided in the image forming apparatus.

In an electrographic image forming apparatus, a replenishment toner (a replenishment developer) is replenished on an electrostatic latent image formed on an image carrier (for example, a photoconductor drum) from a development device to form a toner image. The development device is connected to a toner case so as to replenish the replenishment toner from the toner case to the development device. The toner case configured to replenish the replenishment toner to the development device is attached to a first attached part provided in the image forming apparatus.

A waste toner (a waste developer) remaining on the image carrier after transferring the toner image on a sheet is removed from the surface of the image carrier by a cleaning device and then collected in the toner case. The toner case configured to collect the waste toner is attached to a second attached part provided in the image forming apparatus.

Some of the image forming apparatus having the above configuration use the toner case in combination for the purposes of the replenishment of the replenishment toner to the development device and the collecting of the waste toner. When such a configuration is applied, it is desirable to prevent the waste toner from being incorrectly replenished from the toner case, in which the waste toner has been collected, to the development device.

Consequentially, a configuration (hereinafter, referred to as "a first configuration") configured to destroy a part of the toner case with the attachment of the toner case to the second attached part is provided. Alternatively, another configuration (hereinafter, referred to as "a second configuration") in which a user pushes a handle down to detach the toner case from the second attached part is provided.

Still another configuration (hereinafter, referred to as "a third configuration") is provided, in which an incorrect attachment prevention member movable in three positions including a position showing a new toner case, a position showing an empty toner case and a position showing a waste toner case is attached to the toner case and the above incorrect attachment prevention member is moved by an operation mechanism.

Furthermore, still another configuration (hereinafter, referred to as "a forth configuration") is provided, in which a part of an intermediate gear provided in the toner case is destroyed with the attachment of the toner case to the second attached part so as to stop the rotation of a conveying screw in the toner case.

However, in the first configuration, since a part of the toner case is destroyed with the attachment of the toner case to the second attached part, it is difficult to reuse the toner case. In the second configuration, when a user may forget to push the handle down, the waste toner may be replenished to the development device and therefore it is difficult to prevent the replenishment of the waste toner to the development device.

Furthermore, the third configuration needs a special driving source (a motor or the like) configured to drive the operation mechanism to move the incorrect attachment prevention member, thereby causing an increase in manufacturing cost.

In the forth configuration, since apart of the toner case is destroyed with the attachment of the toner case to the second attached part, it is difficult to reuse the toner case, similar as the first configuration. And, in the forth configuration, a slight amount of the waste toner may be naturally fallen in the development device from the toner case.

SUMMARY

In accordance with an embodiment of the present disclosure, an image forming apparatus includes a toner case, a first attached part and a second attached part. The toner case has a case main body configured to store a replenishment toner or a waste toner. To the first attached part, the toner case is detachably attached. The first attached part has a replenishment port configured to replenish the replenishment toner discharged from the case main body into a development device. To the second attached part, the toner case is detachably attached. The second attached part has a discharge port configured to discharge the waste toner to the case main body. The toner case has a moving member and a driving member. The moving member is capable of moving between a replenishing position where attachment of the toner case to the second attached part is restricted and also attachment of the toner case to the first attached part is permitted and a collecting position where the attachment of the toner case to the second attached part is permitted and also the attachment of the toner case to the first attached part is restricted. The driving member is configured to move the moving member from the replenishing position to the collecting position with at least one of the attachment of the toner case to the first attached part and detachment of the toner case from the first attached part.

In accordance with an embodiment of the present disclosure, a toner case includes a case main body configured to store a replenishment toner or a waste toner. The toner case is provided in an image forming apparatus including a first attached part and a second attached part. To the first attached part and the second attached part, the toner case is detachably attached. The first attached part has a replenishment port configured to replenish the replenishment toner discharged from the case main body into a development device. The second attached part has a discharge port configured to discharge the waste toner to the case main body. The toner case has a moving member and a driving member. The moving member is capable of moving between a replenishing position where attachment of the toner case to the second attached part is restricted and also attachment of the toner case to the first attached part is permitted and a collecting position where the attachment of the toner case to the second attached part is permitted and also the attachment of the toner case to the first attached part is restricted. The driving member is configured to move the moving member from the replenishing position to the collecting position with at least one of the attachment of the toner case to the first attached part and detachment of the toner case from the first attached part.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
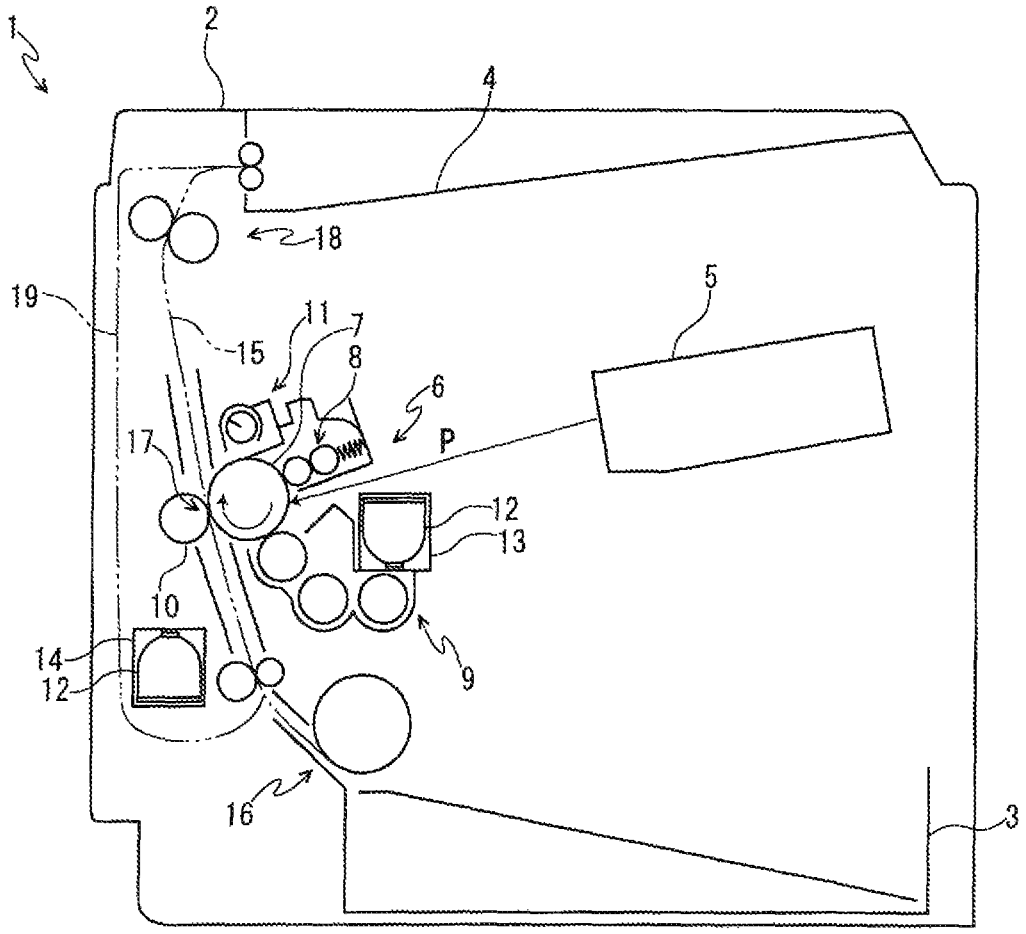
FIG. 1 is a schematic diagram schematically showing a monochrome printer according to an embodiment of the present disclosure.

With reference to FIG. 1, the entire structure of a monochrome printer 1 (an image forming apparatus) will be described.

The monochrome printer 1 includes a box-formed printer main body 2. In a lower part of the printer main body 2, a sheet feeding cartridge 3 storing sheets (not shown) is provided and, in an upper part of the printer main body 2, a sheet ejecting tray 4 is provided.

In a right and upper part of the printer main body 2, an exposure device 5 consisting of a laser scanning unit (LSU) is arranged and, in a left part of the printer main body 2, an image forming unit 6 is provided. In the image forming unit 6, a photosensitive drum 7 (an image carrier) is rotatably provided. Around the photosensitive drum 7, a charger 8, a development device 9, a transfer roller 10 and a cleaning device 11 are arranged along the rotation direction of the photosensitive drum 7.

In the left side part and the left end part of the printer main body 2, a toner case 12 is attached, respectively. The toner case 12 in the left side part of the printer main body 2 is detachably attached to a first attached part 13 of the printer main body 2. The toner case 12 in the left end part of the printer main body 2 is detachably attached to a second attached part 14 of the printer main body 2.

In the left side part of the printer main body 2, a sheet conveying path 15 is provided from the lower part to the upper part. At an upper stream end of the conveying path 15, a sheet feeder 16 is provided. At an intermediate stream part of the conveying path 15, a transferring part 17 composed of the photosensitive drum 7 and the transfer roller 10 is provided. At a lower stream part of the conveying path 15, a fixing device 18 is provided. On the left side of the conveying path 15, a reverse path 19 for duplex printing is provided.

Next, the operation of forming an image by the monochrome printer 1 having such a configuration will be described.

When the power is supplied to the monochrome printer 1, various parameters are initialized and initial determination, such as temperature determination of the fixing device 18, is carried out. Subsequently, when image data is inputted and a printing start is directed from a computer or the like connected with the monochrome printer 1, the image forming operation is carried out as follows.

First, the surface of the photosensitive drum 7 is electrically charged by the charger 8. Then, the surface of the photosensitive drum 7 is irradiated with a laser (refer to an arrow P) by the exposure device 5, thereby forming an electrostatic latent image on the surface of the photosensitive drum 7. And, the developing device 9 develops the electrostatic latent image into a toner image by a toner (a developer).

On the other hand, a sheet fed from the sheet feeding cartridge 3 by the sheet feeder 16 is conveyed to the transferring part 17 in a suitable timing for the above-mentioned image forming operation. Then, at the transferring part 17, the toner image on the photoconductive drum 7 is transferred onto the sheet. The sheet with the transferred toner image is conveyed to a lower stream side on the conveying path 15 to enter the fixing device 18, and then, the toner image is fixed on the sheet in the fixing device 18. The sheet with the fixed toner image is ejected from the downstream end of the conveying path 15 onto the sheet ejecting tray 4.

Next, the toner case 12 will be described. The posture of the toner case 12 is upside down dependent on whether the toner case 12 is attached to the first attached part 13 or the second attached part 14. Hereinafter, for convenience of explanation, the toner case 12 will be described with using words indicating directions, for example the upper and down directions and the left and right directions, based on the posture (shown in FIG. 2 and FIG. 3) in which the toner case 12 is attached to the first attached part 13. Arrows Fr suitably put on each figure indicate a front side of the toner case 12. Arrows X suitably put on each figure indicate an attachment direction (hereinafter, referred to as "an attachment direction X") of the toner case 12 to the first attached part 13 or the second attached part 14. In the present embodiment, the front and back directions indicate the attachment direction X. And, the front side of the monochrome printer 1 indicates the near side in the attachment direction X and the back side of the monochrome printer 1 indicates the far side in the attachment direction X.

Figure 2:
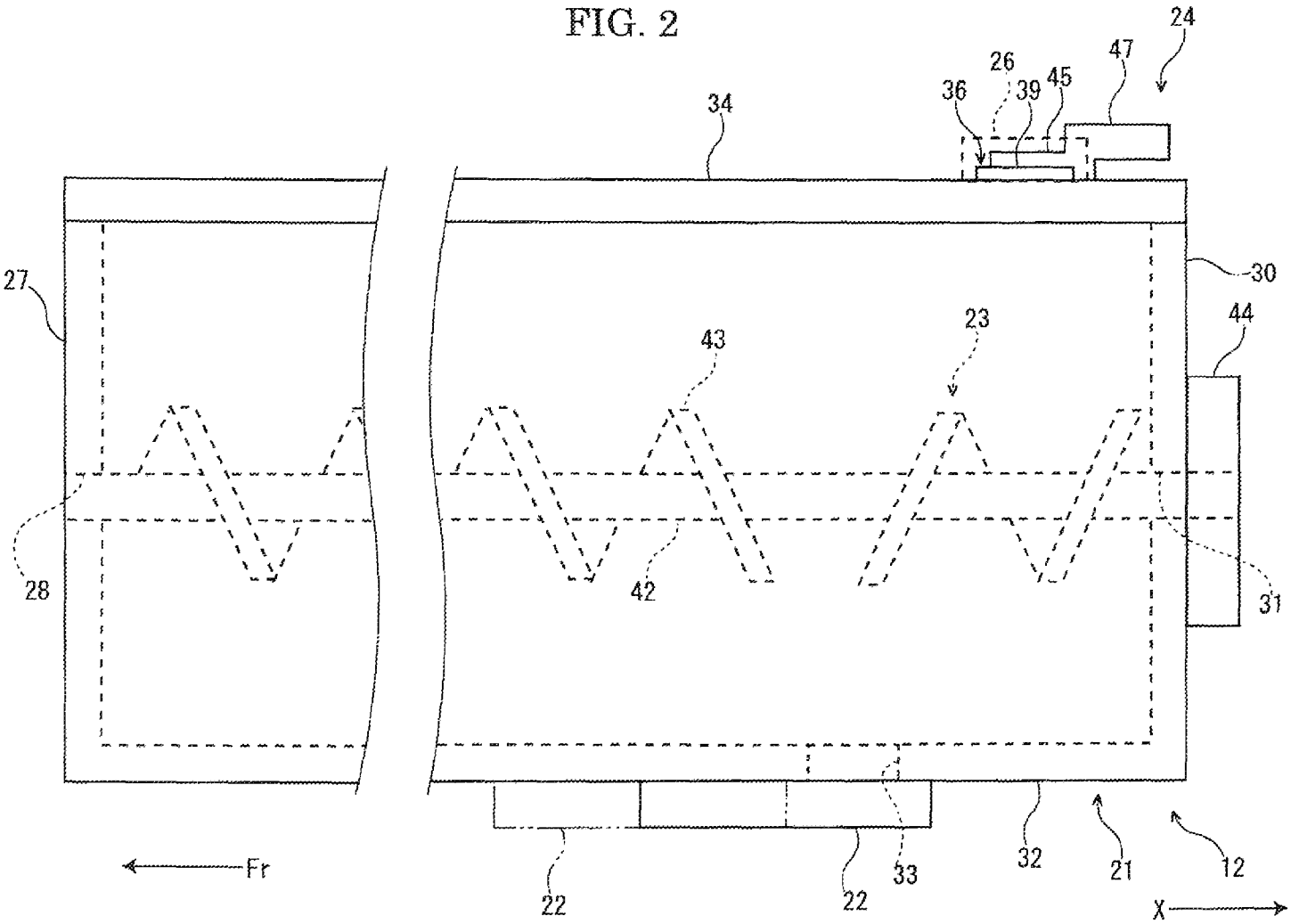
FIG. 2 is a right side view showing a toner case in the monochrome printer according to the embodiment of the present disclosure.
Figure 3:
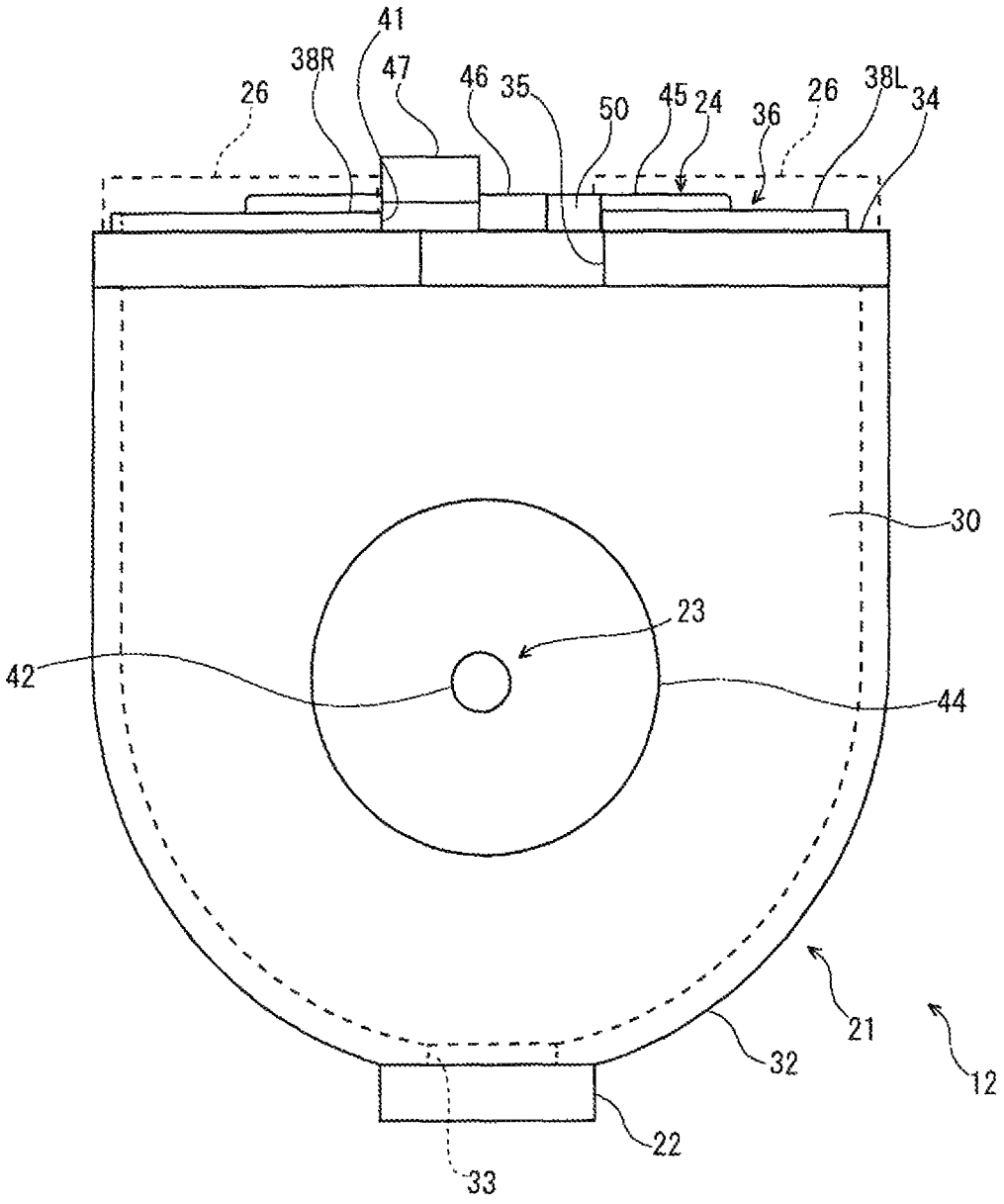
FIG. 3 is a back side view showing the toner case in the monochrome printer according to the embodiment of the present disclosure.
Figure 4:
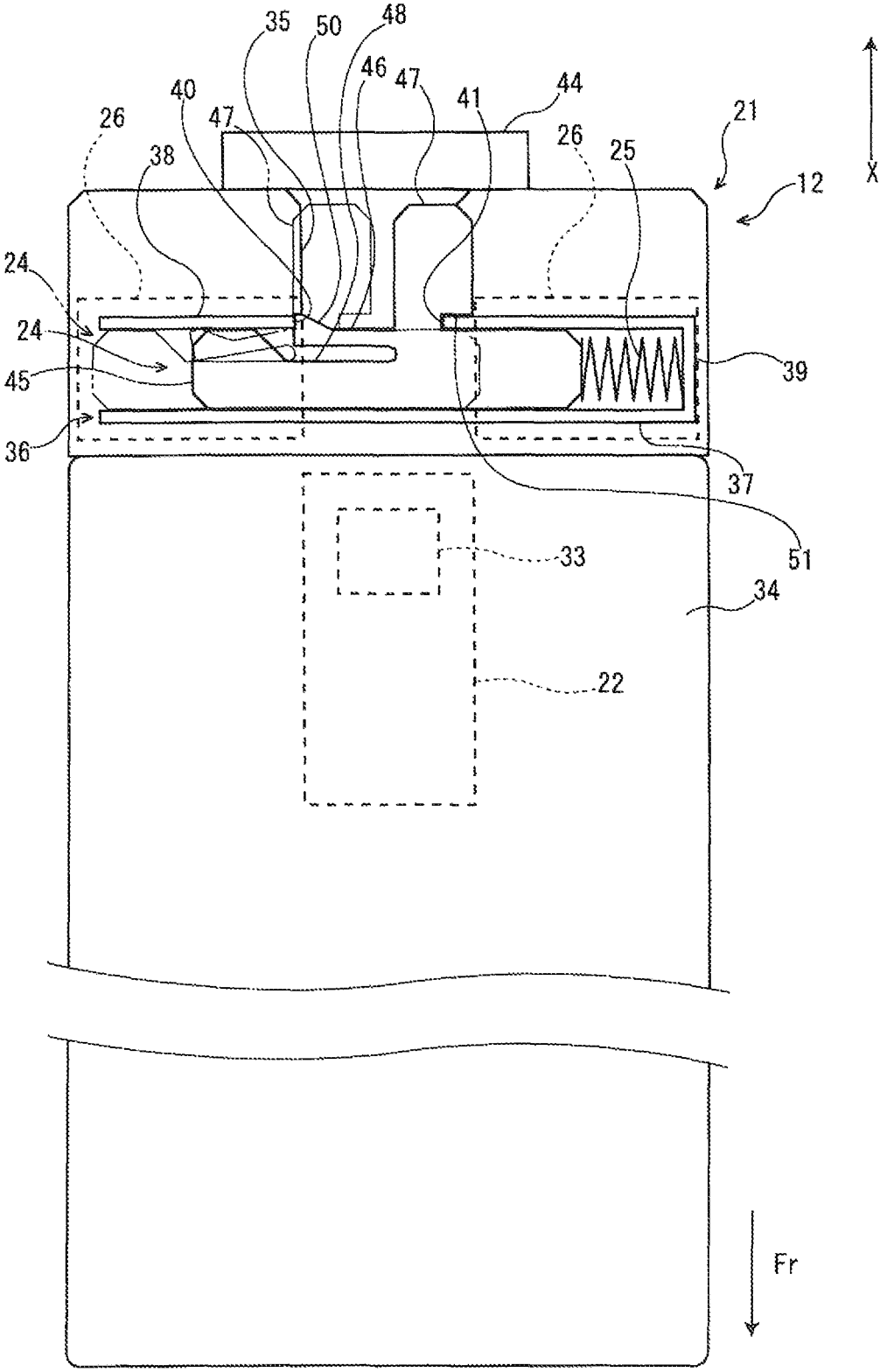
FIG. 4 is a plan view showing the toner case in the monochrome printer according to the embodiment of the present disclosure.

As shown in FIG. 2 to FIG. 4, the toner case 12 is provided with a box-formed case main body 21, a shutter 22 attached to the lower end of the case main body 21, a conveying screw 23 (a conveying member) installed in the middle hollow portion of the case main body 21, a moving member 24 attached to the upper end of the case main body 21, a biasing member 25 (a driving member) arranged on the right side of the moving member 24 and a pair of left and right covering members 26 arranged above the moving member 24 and the biasing member 25.

As mentioned later, the case main body 21 stores the toner (the replenishment toner or the waste toner). As shown in FIG. 2, the case main body 21 is formed with a bearing 28 at the middle portion of the front wall 27. The case main body 21 is formed with a penetrating hole 31 at the middle portion of the back wall 30. As shown in FIG. 3, the bottom wall 32 of the case main body 21 curves into an arc-shape protruding downward. The bottom wall 32 of the case main body 21 has a communicating port 33 extending upward and downward at the lower end portion. The communicating port 33 communicate the inside and the outside of the case main body 21.

As shown in FIG. 4 and others, the top wall 34 of the case main body 21 has an insertion groove 35 at the back end portion. The insertion groove 35 is positioned at the center in the left and right directions and extends along the front and back directions. From the back end portion of the top wall 34 of the case main body 21, a guidance rib 36 protrudes upward. The guidance rib 36 has a pair of front and back guidance wall portions 37 and 38 (the front guidance wall portion 37 and the back guidance wall portion 38) extending along the left and right directions (a direction intersecting with the front and back directions) and a connecting wall portion 39 connecting the right ends of the guidance wall portions 37 and 38 and extending along the front and back directions. A center portion of the back guidance wall portion 38 is notched in the left and right directions. The center portion of the back guidance wall portion 38 corresponds to the insertion groove 35 formed at the top wall 34 of the case main body 21. On the left side of the notched portion, an engaged portion 40 is formed, and, on the right side of the above notched portion, a fitting portion 41 is formed.

As shown in FIG. 2 and others, the shutter 22 is supported at the lower end of the case main body 21. The shutter 22 is movable in the front and back directions to the case main body 21 between a close position (refer to a solid line in FIG. 2) at which the communicating port 33 of the case main body 21 is closed and an open position (refer to a two-dot chain line in FIG. 2) at which the communicating port 33 of the case main body 21 is opened.

The conveying screw 23 has a screw shaft 42 extending in the front and back directions and a spiral fin 43 formed around the screw shaft 42 concentrically. The front end of the screw shaft 42 is rotatably supported by the bearing 28 formed at the front wall 27 of the case main body 21 and the back end of the screw shaft 42 penetrates through the penetrating hole 31 formed at the back wall 30 of the case main body 21. Thus, the conveying screw 23 is rotatably supported by the case main body 21. The back end of the screw shaft 42 protrudes far side from the back wall 30 of the case main body 21 and a driving gear 44 is fixed to the protruded portion.

As shown in FIG. 4 and others, the moving member 24 has an insertion part 45 extending in the left and right directions, an engaging part 46 provided at the back portion (the far side in the attachment direction X) of the left side surface of the insertion part 45 and an interference part 47 protruding backward (the far side in the attachment direction X) from the right side surface of the insertion part 45.

The insertion part 45 is inserted between the pair of front and back guidance wall portions 37 and 38 of the guidance rib 36. Thus, the moving member 24 is guided so as to move along the left and right directions (a direction intersecting with the attachment direction X) by the guidance rib 36. At the left portion of the back surface (the far side surface in the attachment direction X) of the insertion part 45, a hollow portion 48 recessed forward is formed.

The engaging part 46 extends in the left and right directions. The engaging part 46 is provided on the back side (the far side in the attachment direction X) of the hollow portion 48 of the insertion part 45. The engaging part 46 is arranged opposite to the hollow portion 48 through interval. The proximal end (the right end) of the engaging part 46 is connected to the center portion of the insertion part 45 in the left and right directions. The distal end (the left end) of the engaging part 46 is engaged (contacts) with the engaged portion 40 formed at the back guidance wall portion 38 of the guidance rib 36. The engaging part 46 has a pressed portion 50 at the distal end portion (the left end portion) of the back surface (the far side surface in the attachment direction X). The pressed portion 50 inclines leftward (the distal side of the engaging part 46) toward the back side (the far side in the attachment direction X).

The interference part 47 is provided along the front and back directions and formed into an approximately parallelepiped shape. The interference part 47 is arranged above the insertion groove 35 formed at the top wall 34 of the case main body 21. Hereinafter, a position of the moving member 24 when the interference part 47 is positioned on the right and upper portion in the insertion groove 35 (shown in the solid line in FIG. 4) is referred to "a replenishing position". On contrary, a position of the moving member 24 when the interference part 47 is positioned on the left and upper portion in the insertion groove 35 (shown in the two-dot chain line in FIG. 4) is referred to "a collecting position". The moving member 24 is movable between the replenishing position and the collecting position. On the right surface of the proximal end portion (the front end portion) of the interference part 47, a fitting depression 51 is provided along the left and right directions (a direction intersecting with the attachment direction X). Under a state in which the moving member 24 is positioned at the replenishing position, the fitting portion 41 formed at the back guidance wall portion 38 of the guidance rib 36 is fitted into the fitting depression 51.

The biasing member 25 is composed of a coil spring, for example. The right end of the biasing member 25 comes in contact with the connecting wall portion 39 of the guidance rib 36. The left end of the biasing member 25 comes in contact with the right end surface of the insertion part 45 of the moving member 24. That is, the biasing member 25 is installed between the guidance rib 36 and the moving member 24. The biasing member 25 biases the moving member 24 toward the collecting position.

Each of the covering members 26 is formed into an approximately parallelepiped shape. The left covering member 26 covers the left portion of the insertion part 45 of the moving member 24 from above. The right covering member 26 covers the right portion of the insertion part 45 of the moving member 24 and the biasing member 25 from above. This prevents the moving member 24 and the biasing member 25 from being fallen from the case main body 21. In order to clearly show the members arranged under each of the covering members 26, the contour of each covering member 26 is only shown with a dot line.

Figure 5:
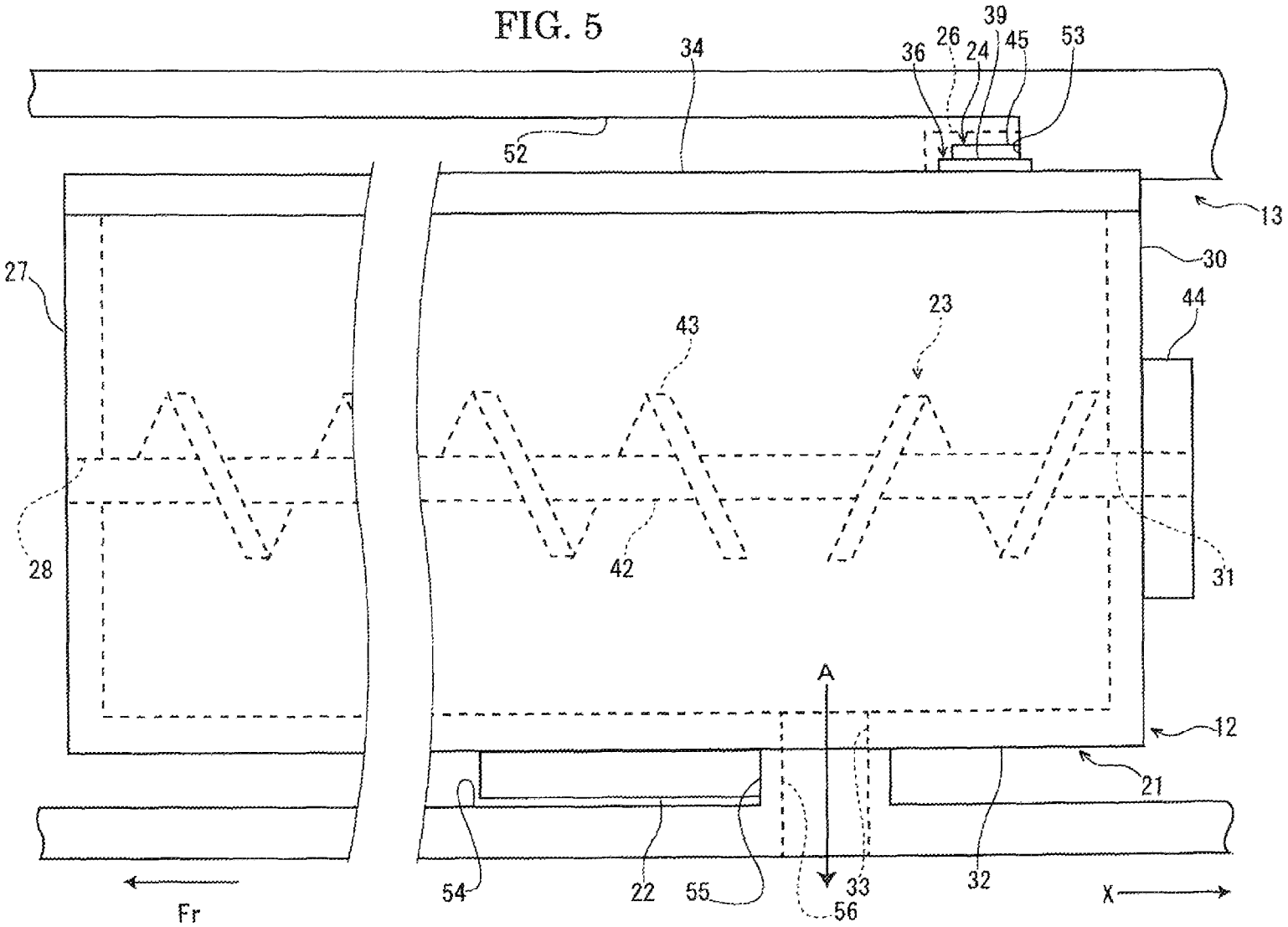
FIG. 5 is a right side view showing the toner case attached to a first attached part in the monochrome printer according to the embodiment of the present disclosure.
Figure 6:
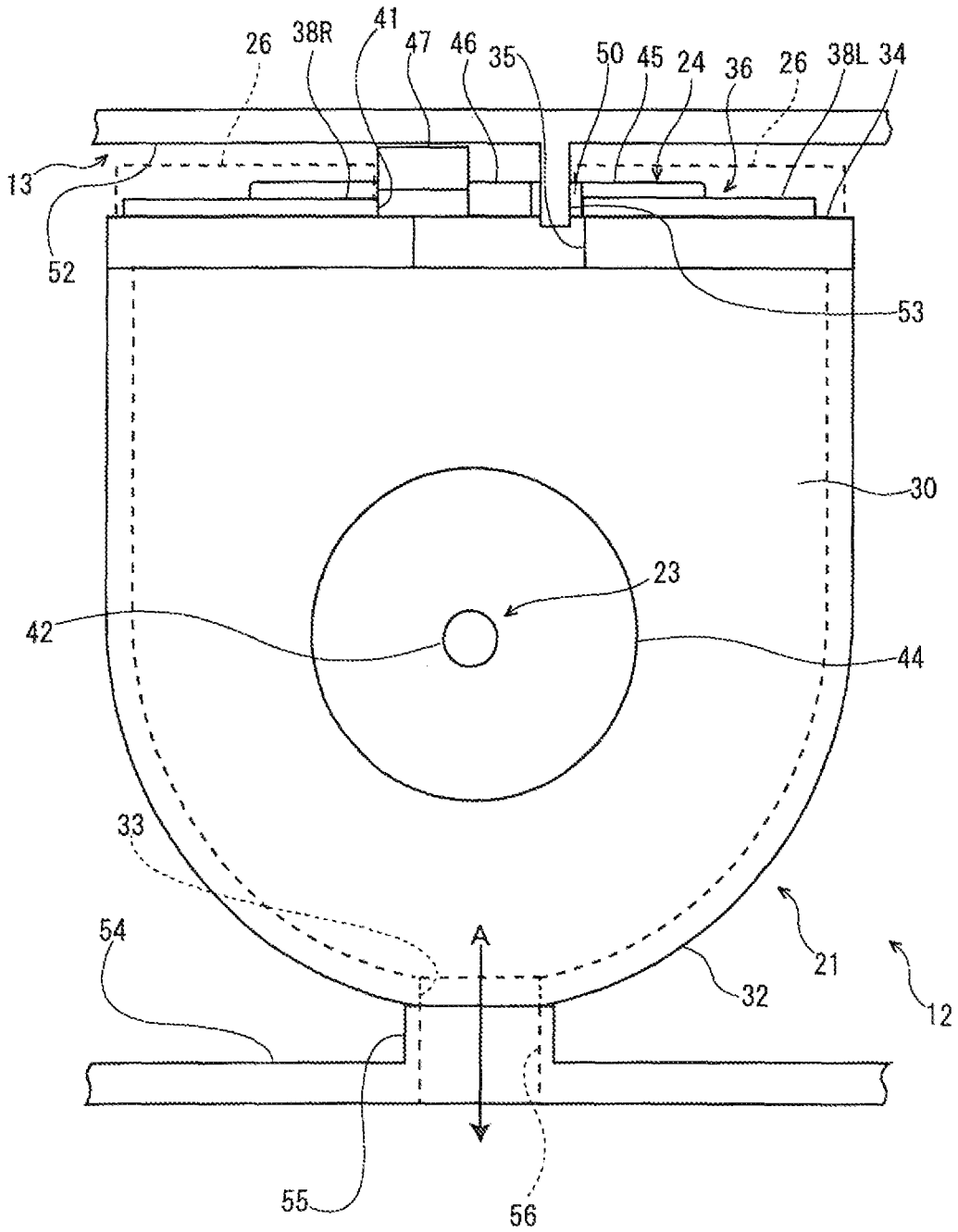
FIG. 6 is a back side view showing the toner case attached to the first attached part in the monochrome printer according to the embodiment of the present disclosure.

Next, the first attached part 13 will be described. As shown in FIG. 5 and FIG. 6, to the first attached part 13, the toner case 12 is detachably attached.

The first attached part 13 is provided with a replenishing side protruded portion 53 at the back end portion (the far side end portion in the attachment direction X) of the top wall 52. The replenishing side protruded portion 53 protrudes downward (to the side of the toner case 12). The first attached part 13 is provided with a replenishing side contacting portion 55 protruding upward (to the side of the toner case 12) at the back portion of the bottom wall 54. The back portion of the bottom wall 54 of the first attached part 13 is provided with a replenishment port 62 penetrating the replenishing side contacting portion 55 in the upper and lower directions. The replenishment port 56 is connected to the development device 9 (as shown in FIG. 1).

Figure 7:
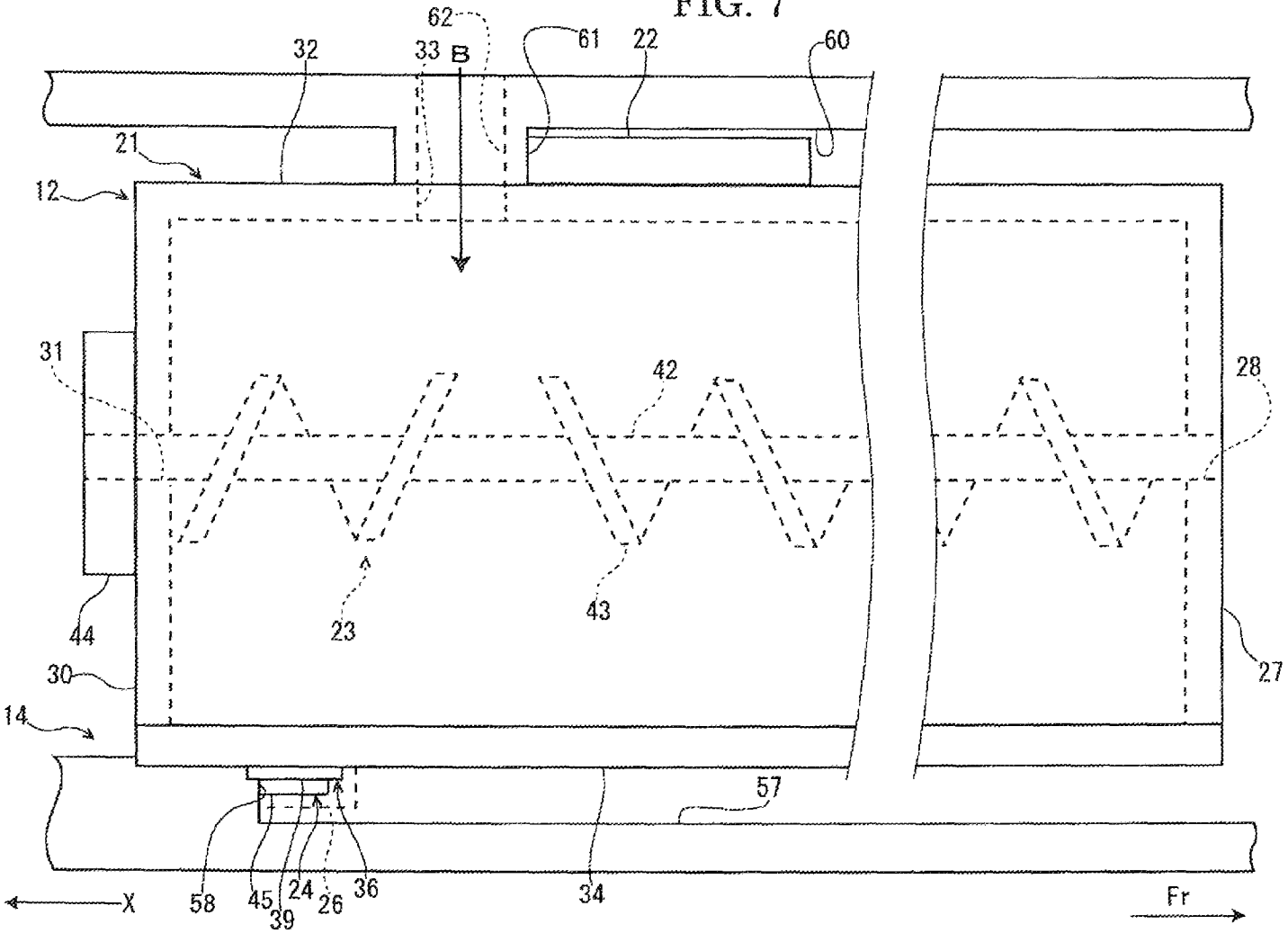
FIG. 7 is a right side view showing the toner case attached to a second attached part in the monochrome printer according to the embodiment of the present disclosure.
Figure 8:
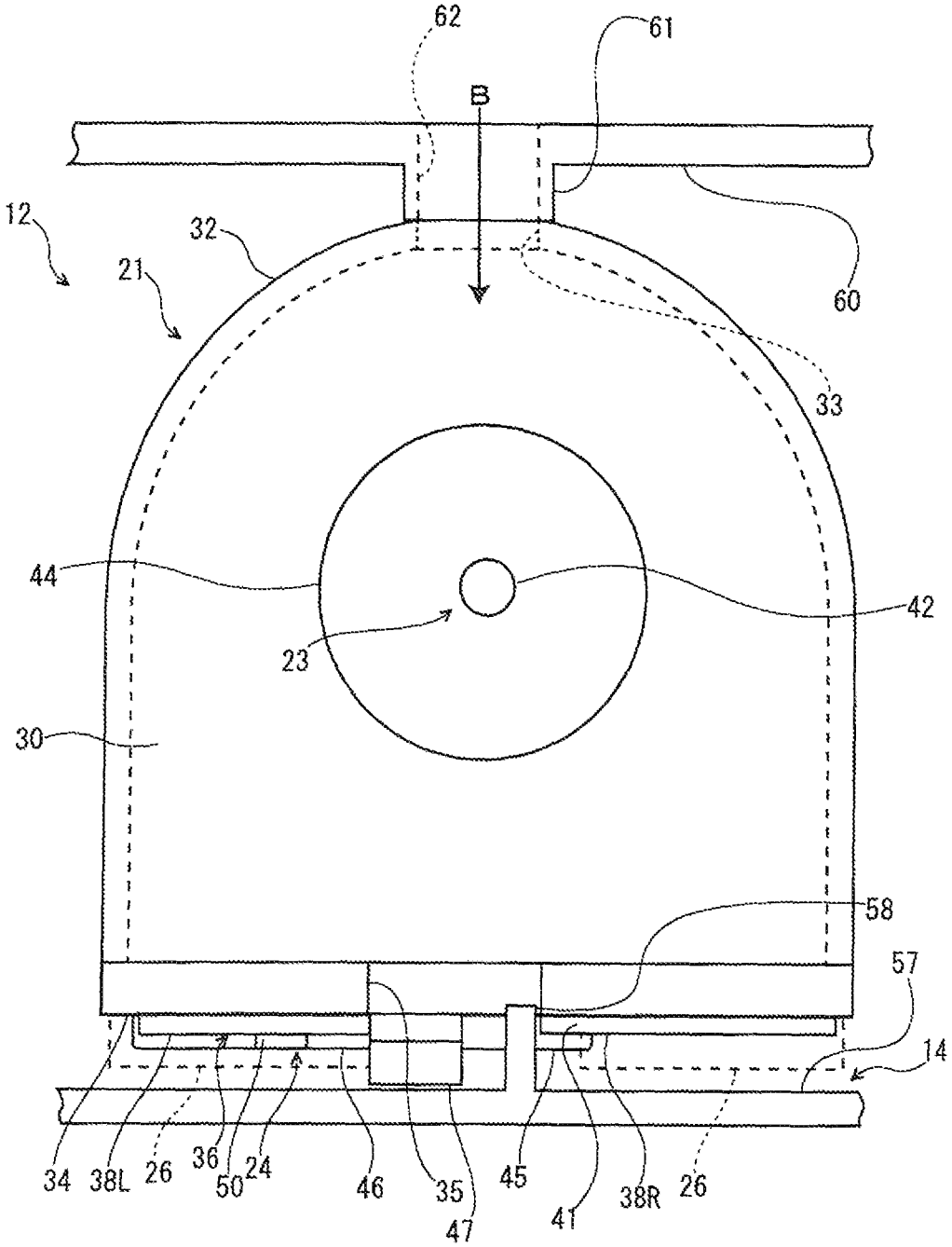
FIG. 8 is a back side view showing the toner case attached to the second attached part in the monochrome printer according to the embodiment of the present disclosure.

Next, the second attached part 14 will be described. As shown in FIG. 7 and FIG. 8, to the second attached part 14, the toner case 12 is detachably attached.

The second attached part 14 is provided with a collecting side protruded portion 58 at the back end portion (the far side end portion in the attachment direction X) of the bottom wall 57. The collecting side protruded portion 58 protrudes upward (to the side of the toner case 12). The second attached part 14 is provided with a collecting side contacting portion 61 protruding downward (to the side of the toner case 12) at the back portion of the top wall 60. The back portion of the top wall 60 of the second attached part 14 is provided with a discharge port 62 penetrating the collecting side contacting portion 61 in the upper and lower directions. The discharge port 62 is connected to the cleaning device 11 (as shown in FIG. 1).

In the above-mentioned configuration, when the toner case 12 is used for the purpose of the replenishment of the replenishment toner to the development device 9, the toner case 12 is attached to the first attached part 13. When the toner case 12 is attached to the first attached part 13 in the above way, the driving gear 44 of the toner case 12 is connected to a replenishing driving source (not shown) composed of a motor and others. And, as shown in FIG. 5, the replenishing side contacting portion 55 of the first attached part 13 comes in contact with the shutter 22 of the toner case 12 to move the shutter 22 from the close position to the open position.

Under the above situation, when the driving gear 44 is rotated by the above replenishing driving source, the conveying screw 23 is rotated with the driving gear 44. With the rotation, as shown in an arrow A in FIG. 5 and FIG. 6, the replenishment toner stored in the case main body 21 of the toner case 12 is discharged from the communicating port 33 of the case main body 21. The replenishment toner discharged through the communicating port 33 from the case main body 21 is replenished into the development device 9 through the replenishment port 56 of the first attached part 13. When the replenishment toner in the case main body 21 is consumed, the toner case 12 is detached from the first attached part 13. With the detachment, the shutter 22 moves from the open position to the close position.

After completing the use for the purpose of the replenishment of the replenishment toner to the development device 9 in the above mentioned way, the toner case 12 is then used for the purpose of the collecting of the waste toner. When the toner case 12 is used for the purpose of the collecting of the waste toner, the posture of the toner case 12 when being used for the purposed of the replenishment of the replenishment toner to the development device 9 is upside down and then attached to the second attached part 14. When the toner case 12 is attached to the second attached part 14 in the above way, the driving gear 44 of the toner case 12 is connected to a collecting driving source (not shown) composed of a motor and others. And, as shown in FIG. 7, the collecting side contacting portion 61 of the second attached part 14 comes in contact with the shutter 22 of the toner case 12 to move the shutter 22 from the close position to the open position.

Under the above situation, after removing the waste toner from the surface of the photoconductive drum 9 by the cleaning device 11, the waste toner is conveyed from the cleaning device 11 to the discharge port 62 of the second attached part 14. The waste toner, as shown in an allow B in FIG. 7 and FIG. 8, is discharged through the discharge port 62 of the second attached part 14 to the communicating port 33 of the toner case 12.

When the toner case 12 is used for the purpose of the collecting of the waste toner as mentioned above, the driving gear 44 is rotated by the above mentioned collecting driving source. With the rotation, the conveying screw 23 is rotated in the opposite direction to the rotation direction when the toner case 12 is used for the purpose of the replenishment of the replenishment toner to the development device 9. And, the waste toner discharged through the discharge port 62 of the second attached part 14 to the communicating port 33 of the toner case 12 is collected into the case main body 21 of the toner case 12.

As mentioned above, in the present embodiment, the toner case 12 is used in combination for the purposes of the replenishment of the replenishment toner to the development device 9 and the collecting of the waste toner. In such a case, it is desirable to prevent the waste toner from being incorrectly replenished from the toner case 12, in which the waste toner is collected, to the development device 9. Hereinafter, the way to prevent the waste toner from being incorrectly replenished from the toner case 12 to the development device 9 will be described.

Figure 9A:
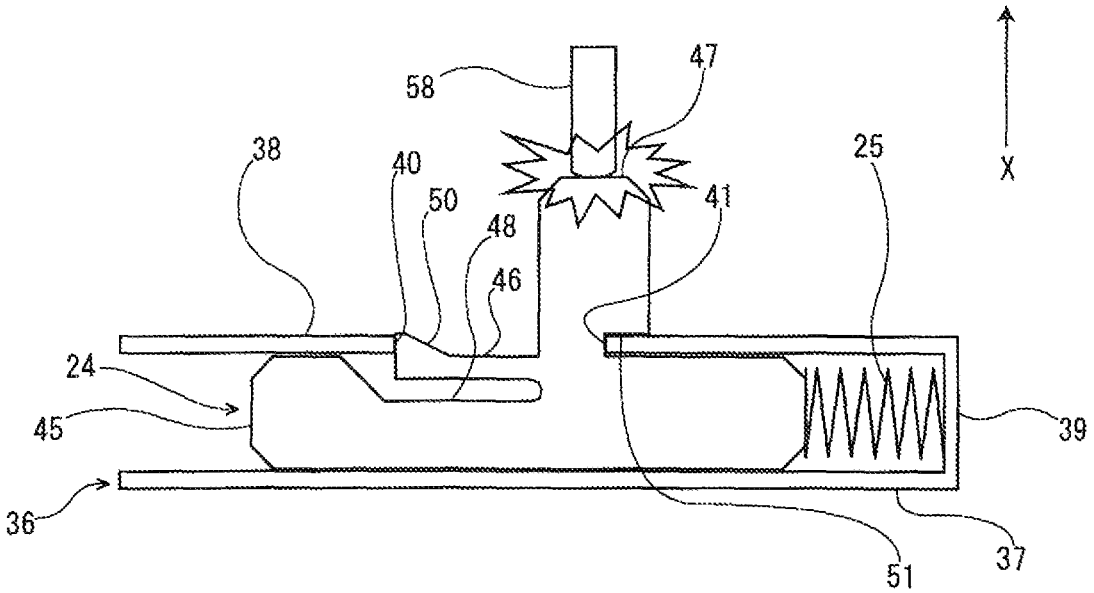
FIG. 9A is a view explaining a situation where the moving member is positioned at the replenishing position and the collecting side protruded portion interferes with the interference portion, in the monochrome printer according to the embodiment of the present disclosure.

Before attaching the toner case 12 to the first attached part 13, that is, when the case main body 21 is fully filled with the replenishment toner, as shown in FIG. 9A, the distal end of the engaging part 46 of the moving member 24 is engaged (contacts) with the engaged portion 40 of the guidance rib 36. Therefore, the moving member 24 is kept at the replenishing position against the biasing force of the biasing member 25 and the fitting portion 41 of the guidance rib 36 is fitted into the fitting depression 51 of the moving member 24.

Under a situation in which the moving member 24 is positioned at the replenishing position, when the toner case 12 is attached to the second attached part 14, since the interference part 47 of the moving member 24 interferes with the collecting side protruded portion 58 of the second attached part 14, the attachment of the toner case 12 to the second attached part 14 is restricted.

Figure 9B:
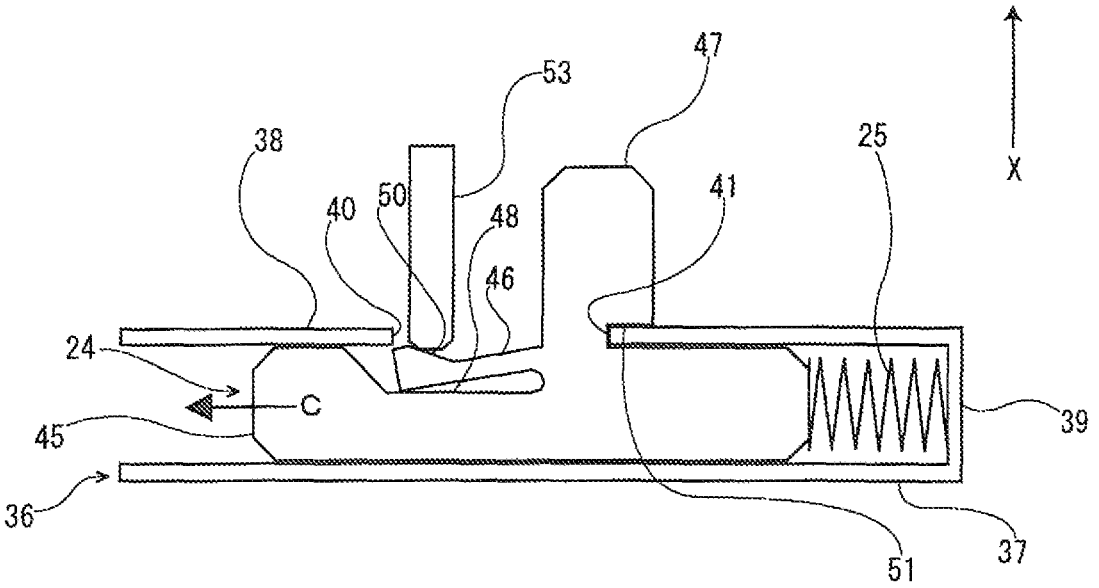
FIG. 9B is a view explaining a situation where the moving member is positioned at the replenishing position and the interference of the replenishing side protruded portion with the interference portion is prevented, in the monochrome printer according to the embodiment of the present disclosure.

On the other hand, under a situation in which the moving member 24 is positioned at the replenishing position, when the toner case 12 is attached to the first attached part 13, as shown in FIG. 9B, since the interference of the interference part 47 of the moving member 24 with the replenishing side protruded portion 53 of the first attached part 13 is prevented, the attachment of the toner case 12 to the first attached part 13 is permitted.

Figure 10A:
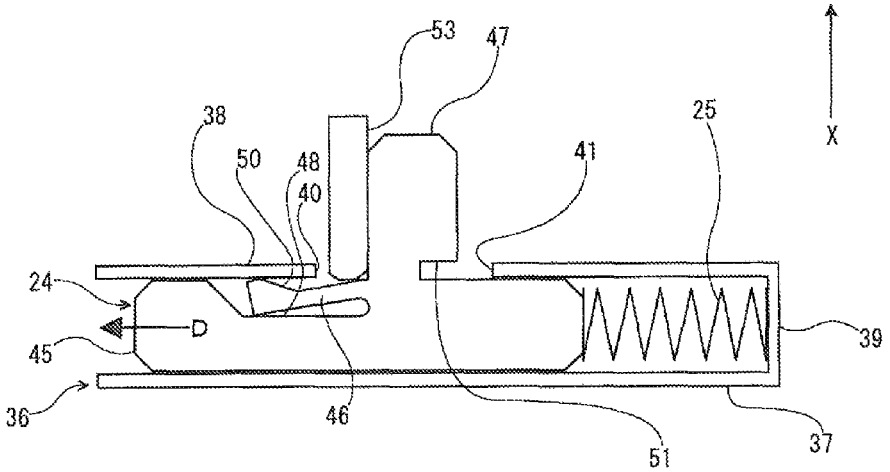
FIG. 10A is a view explaining a situation where the moving member is positioned at the intermediate position, in the monochrome printer according to the embodiment of the present disclosure.

When the toner case 12 is attached to the first attached part 13 in this way, the replenishing side protruded portion 53 of the first attached part 13 presses the pressed portion 50 formed at the engaging part 46 of the moving member 24. This elastically deforms the engaging part 46 of the moving member 24 forward (the near side in the attachment direction X) and therefore the engaging part 46 of the moving member 24 is disengaged with the engaged portion 40 of the guidance rib 36. With this disengagement, as shown in an arrow C in FIG. 9B, the moving member 24 moves leftward from the replenishing position by the biasing force of the biasing member 25. As shown in FIG. 10A, since the interference part 47 of the moving member 24 comes in contact with the replenishing side protruded portion 53 of the first attached part 13 to restrict the leftward movement of the moving member 24, the moving member 24 does not reach the collecting position and stops at "an intermediate position" positioned between the replenishing position and the collecting position.

Figure 10B:
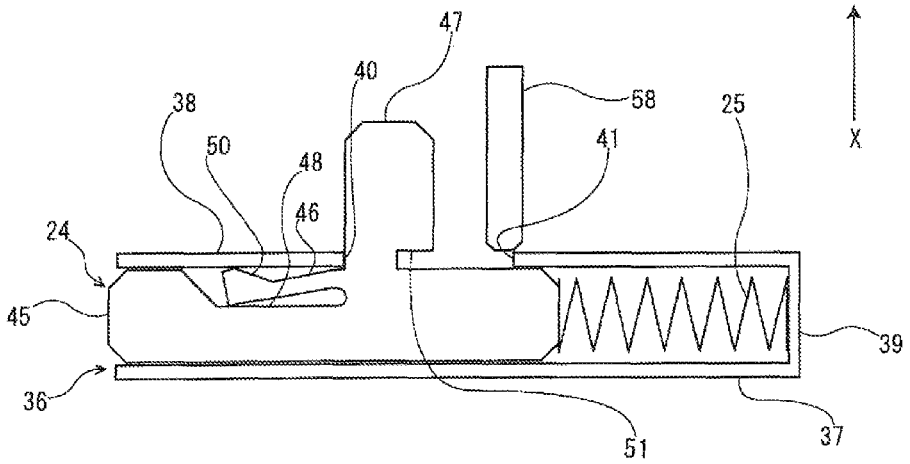
FIG. 10B is a view explaining a situation where the moving member is positioned at the collecting position and the interference of the collecting side protruded portion with the interference portion is prevented, in the monochrome printer according to the embodiment of the present disclosure.

When the toner in the toner case 12 is consumed, the toner case 12 is detached from the first attached part 13. With the detachment, as shown in an arrow D in FIG. 10A, the moving member 24 moves leftward from the intermediate position by the biasing force of the biasing member 25 and, as shown in FIG. 10B, the moving member 24 reaches the collecting position. Under this state, when the toner case 12 is attached to the second attached part 14, since the interference of the interference part 47 of the moving member 24 with the collecting side protruded portion 58 of the second attached part 14 is prevented, the attachment of the toner case 12 to the second attached part 14 is permitted.

Figure 11A:
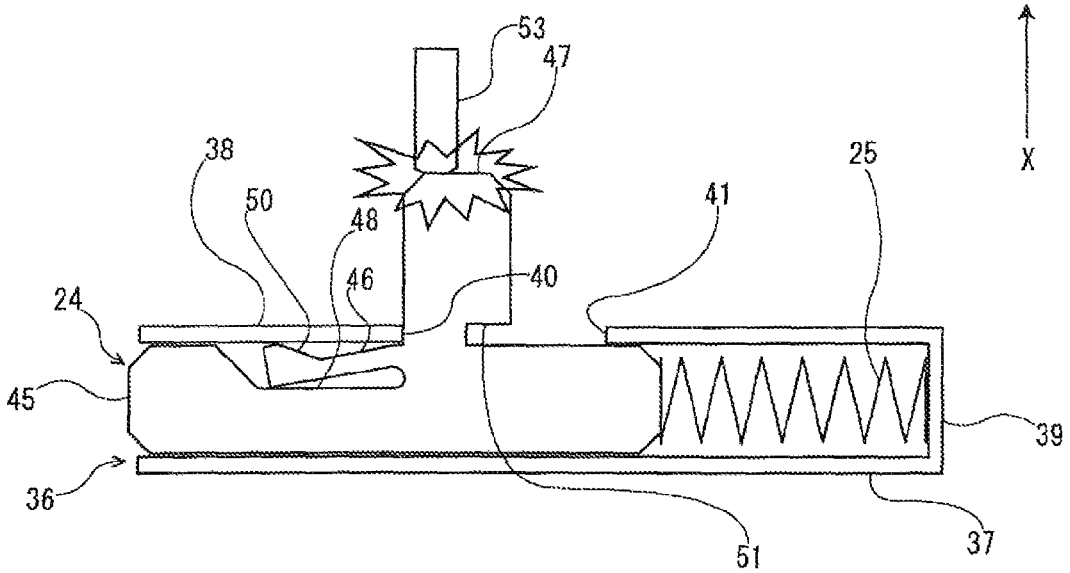
FIG. 11A is a view explaining a situation where the moving member is positioned at the collecting position and the replenishing side protruded portion interferes with the interference portion, in the monochrome printer according to the embodiment of the present disclosure.

On the other hand, under a situation in which the moving member 24 is positioned at the collecting position, as shown in FIG. 11A, when the toner case 12 is attached to the first attached part 13, since the interference part 47 of the moving member 24 interferes with the replenishing side protruded portion 53 of the first attached part 13, the attachment of the toner case 12 to the first attached part 13 is restricted.

Figure 11B:
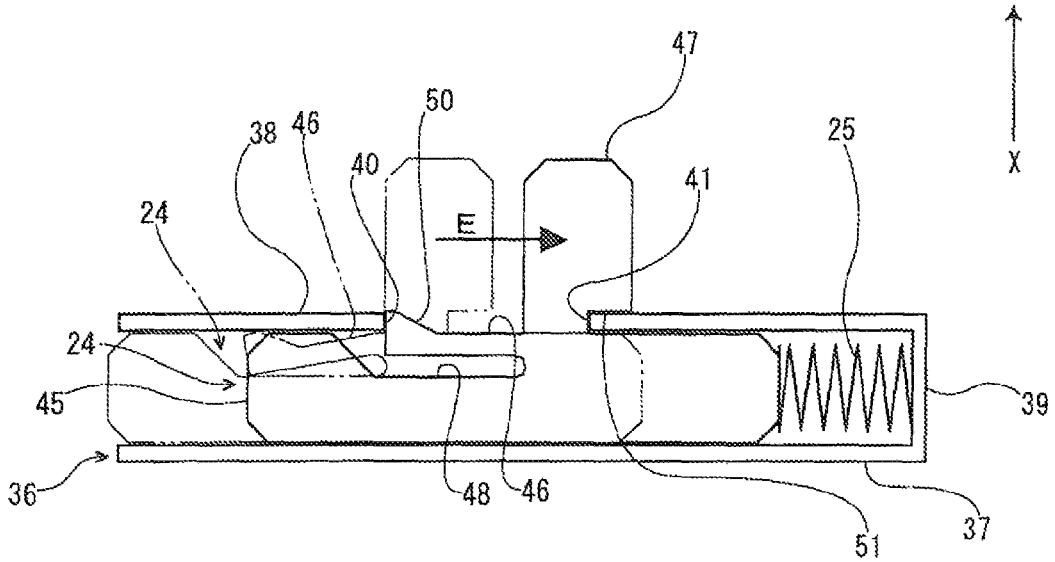
FIG. 11B is a view explaining a situation where the moving member is manually moved from the collecting position to the replenishing position, in the monochrome printer according to the embodiment of the present disclosure.

When the toner case 12 is detached from the first attached part 13 for the purpose of maintenance or the like with the replenishment toner remained in the inside of the toner case 12, as shown in an arrow E in FIG. 11B, an operator, such as a user or a serviceman, moves the moving member 24 manually from the collecting position to the replenishing position. This elastically returns the engaging part 46 of the moving member 24 backward (the far side in the attachment direction X) and therefore the distal end of the engaging part 46 of the moving member 24 is engaged (contacts) with the engaged portion 40 of the guidance rib 36 and therefore the moving member 24 is kept at the replenishing position against the biasing force of the biasing member 25. Accordingly, it becomes possible to attach the toner case 12 to the first attached part 13 again.

As mentioned above, the present embodiment is configured such that the biasing member 25 moves the moving member 24 from the replenishing position to the collecting position with the attachment of the toner case 12 to the first attached part 13 and the detachment of the toner case 12 from the first attached part 13. By applying such a configuration, after the toner case 12 is removed from the first attached part 13 once, the attachment of the toner case 12 to the first attached part 13 is restricted and the attachment of the toner case 12 to the second attached part 14 is permitted. Thus, the toner case 12 in which the waste toner has been collected can be prevented from being incorrectly attached to the first attached part 13 surely. Accordingly, it becomes possible to prevent the waste toner from being replenished from the toner case 12 to the development device 9 surely.

Since the present embodiment has a configuration in which the biasing member 25 moves the moving member 24 automatically, an operator, such as a user or a serviceman, does not need to move the moving member 24 manually and the operator may not forget to move the moving member 24 manually. Accordingly, the toner case 12 in which the waste toner has been collected can be prevented from being incorrectly attached to the first attached part 13 more surely.

In the present embodiment, it becomes possible to move the moving member 24 from the replenishing position to the collecting position without destroying the components (for example, the case main body 21 and the moving member 24) of the toner case 12. Accordingly, the toner case 12 can be reused easily. And, since the driving member is composed of the biasing member 25, the manufacturing cost can decrease compared with a case in which the driving member is composed of a driving source (a motor or the like).

The replenishing side protruded portion 53 of the first attached part 13 is configured so as not to interference with the interference part 47 of the moving member 24 when the moving member 24 is positioned at the replenishing position and to interfere with the interference part 47 of the moving member 24 when the moving member 24 is positioned at the collecting position. By applying such a configuration, it becomes possible to surely prevent the toner case 12 from being attached to the first attached part 13 when the moving member 24 is positioned at the collecting position.

The collecting side protruded portion 58 of the second attached part 14 is configured so as to interference with the interference part 47 of the moving member 24 when the moving member 24 is positioned at the replenishing position and not to interfere with the interference part 47 of the moving member 24 when the moving member 24 is positioned at the collecting position. By applying such a configuration, it becomes possible to surely prevent the toner case 12 from being attached to the second attached part 14 when the moving member 24 is positioned at the replenishing position.

When the moving member 24 is positioned at the replenishing position, the fitting portion 41 of the guidance rib 36 is fitted into the fitting depression 51 provided in the interference part 47 of the moving member 24. By applying such a configuration, it becomes possible to keep the moving member 24 at the replenishing position surely.

In the present embodiment, the communicating port 33 provided in the case main body 21 of the toner case 12 is used in combination as the discharge port of the replenishment toner and the charge port of the waste toner. On the other hand, in another embodiment, the discharge port of the replenishment toner and the charge port of the waste toner may be provided independently in the case main body 21 of the toner case 12.

In this embodiment, the moving member 24 moves from the replenishing position to the collecting position with the attachment of the toner case 12 to the first attached part 13 and the detachment of the toner case 12 from the first attached part 13. On the other hand, in another embodiment, the moving member 24 may move from the replenishing position to the collecting position with either one of the attachment of the toner case 12 to the first attached part 13 and the detachment of the toner case 12 from the first attached part 13.

In the present embodiment, a coil spring is used as the biasing member 25. In another embodiment, a plate spring or a wire spring may be used as the biasing member 25. And, the present embodiment uses the biasing member 25 as the driving member, in another embodiment, a motor or a solenoid may be used as the driving member.

Although the embodiment was described in a case where configurations of the disclosure are applied into the monochrome printer 1, in another different embodiment, the configurations of the disclosure may be applied into another image forming apparatus, such as a color printer, a copying machine, a facsimile, multifunctional peripheral or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner case having a case main body configured to store a replenishment toner or a waste toner;

a first attached part to which the toner case is detachably attached, the first attached part having a replenishment port configured to replenish the replenishment toner discharged from the case main body into a development device; and a second attached part to which the toner case is detachably attached, the second attached part having a discharge port configured to discharge the waste toner to the case main body;

wherein the toner case includes, a moving member capable of moving between a replenishing position where attachment of the toner case to the second attached part is restricted and also attachment of the toner case to the first attached part is permitted and a collecting position where the attachment of the toner case to the second attached part is permitted and also the attachment of the toner case to the first attached part is restricted; and a driving member configured to move the moving member from the replenishing position to the collecting position with at least one of the attachment of the toner case to the first attached part and detachment of the toner case from the first attached part.

2. The image forming apparatus according to claim 1, wherein the case main body has a guidance rib configured to guide the moving member so as to be able to move along a direction intersecting with an attachment direction of the toner case to the first attached part, the guidance rib has an engaged portion, the moving member has an engaging part engageable with the engaged portion, the driving member is a biasing member configured to bias the moving member toward the collecting position, the first attached part has a replenishing side protruded portion protruding toward the toner case side, before the attachment of the toner case to the first attached part, the engaging part is engaged with the engaged portion to keep the moving member at the replenishing position against the biasing force of the biasing member, when the toner case is attached to the first attached part, the replenishing side protruded portion presses the engaging part to elastically deform the engaging part toward a near side in the attachment direction and then the engagement of the engaging part with the engaged portion is released to move the moving member from the replenishing position to an intermediate position, which is positioned between the replenishing position and the collecting position, by the biasing force of the biasing member, and when the toner case is detached from the first attached part, the moving member moves from the intermediate position to the collecting position by the biasing force of the biasing member.

3. The image forming apparatus according to claim 2, wherein when the moving member is manually moved from the collecting position to the replenishing position, the engaging part is elastically returned toward afar side in the attachment direction to engage with the engaged portion.

4. The image forming apparatus according to claim 2, wherein the moving member has an interference part protruding toward a far side in the attachment direction, and the replenishing side protruded portion is configured to be prevented from interfering with the interference part under a situation where the moving member is positioned at the replenishing position and to interfere with the interference part under a situation where the moving member is positioned at the collecting position.

5. The image forming apparatus according to claim 4, wherein the second attached part has a collecting side protruded portion protruding toward the toner case side, and the collecting side protruded portion is configured to interfere with the interference part under a situation where the moving member is positioned at the replenishing position and to be prevented from interfering with the interference part under a situation where the moving member is positioned at the collecting position.

6. The image forming apparatus according to claim 4, wherein the interference part has a fitting depression provided along the direction intersecting with the attachment direction of the toner case to the first attached part, and the guidance rib has a fitting portion fitted into the fitting depression under a situation where the moving member is positioned at the replenishing position.

7. The image forming apparatus according to claim 2, wherein the guidance rib has a pair of guidance wall portions extending along a direction intersecting with the attachment direction; and a connecting wall portion connecting the guidance wall portions.

8. The image forming apparatus according to claim 7, wherein the case main body has an insertion groove; and a portion of the guidance wall portion provided on the far side in the attachment direction is notched, the portion corresponding to the insertion groove.

9. The image forming apparatus according to claim 7, wherein the moving member has an insertion part configured to be inserted into a space between the pair of guidance wall portions, and the engaging part is provided on the far side in the attachment direction with respect to the insertion part.

10. A toner case which has a case main body configured to store a replenishment toner or a waste toner and is provided in an image forming apparatus including a first attached part and a second attached part to which the toner case is detachably attached, the first attached part having a replenishment port configured to replenish the replenishment toner discharged from the case main body into a development device, the second attached part having a discharge port configured to discharge the waste toner to the case main body, the toner case comprising:

a moving member capable of moving between a replenishing position where attachment of the toner case to the second attached part is restricted and also attachment of the toner case to the first attached part is permitted and a collecting position where the attachment of the toner case to the second attached part is permitted and also the attachment of the toner case to the first attached part is restricted; and a driving member configured to move the moving member from the replenishing position to the collecting position with at least one of the attachment of the toner case to the first attached part and detachment of the toner case from the first attached part.

11. The toner case according to claim 10, wherein the case main body has a guidance rib configured to guide the moving member so as to be able to move along a direction intersecting with attachment direction of the toner case to the first attached part, the guidance rib has an engaged portion, the moving member has an engaging part engageable with the engaged portion, the driving member is a biasing member configured to bias the moving member toward the collecting position, the first attached part has a replenishing side protruded portion protruding toward the toner case side, before the attachment of the toner case to the first attached part, the engaging part is engaged with the engaged portion to keep the moving member at the replenishing position against the biasing force of the biasing member, when the toner case is attached to the first attached part, the replenishing side protruded portion presses the engaging part to elastically deform the engaging part toward the near side in the attachment direction and then the engagement of the engaging part with the engaged portion is released to move the moving member from the replenishing position to an intermediate position, which is positioned between the replenishing position and the collecting position, by the biasing force of the biasing member, and when the toner case is detached from the first attached part, the moving member moves from the intermediate position to the collecting position by the biasing force of the biasing member.

12. The toner case according to claim 11, wherein when the moving member is manually moved from the collecting position to the replenishing position, the engaging part is elastically returned backward in the attachment direction to engage with the engaged portion.

13. The toner case according to claim 11, wherein the moving member has an interference part protruding backward in the attachment direction, and the replenishing side protruded portion is configured to be prevented from interfering with the interference part under a situation where the moving member is positioned at the replenishing position and to interfere with the interference part under a situation where the moving member is positioned at the collecting position.

14. The toner case according to claim 13, wherein the second attached part has a collecting side protruded portion protruding toward the toner case side, and the collecting side protruded portion is configured to interfere with the interference part under a situation where the moving member is positioned at the replenishing position and to be prevented from interfering with the interference part under a situation where the moving member is positioned at the collecting position.

15. The toner case according to claim 13, wherein the interference part has a fitting depression provided along the direction intersecting with the attachment direction of the toner case to the first attached part, and the guidance rib has a fitting portion fitted into the fitting depression under a situation where the moving member is positioned at the replenishing position.

16. The toner case according to claim 11, wherein the guidance rib has a pair of guidance wall portions extending along a direction intersecting with the attachment direction; and a connecting wall portion connecting the guidance wall portions.

17. The toner case according to claim 16, wherein the case main body has an insertion groove; and a portion of the guidance wall portion provided on the far side in the attachment direction is notched, the portion corresponding to the insertion groove.

18. The toner case according to claim 16, wherein the moving member has an insertion part configured to be inserted into a space between the pair of guidance wall portions, and the engaging part is provided on the far side in the attachment direction with respect to the insertion part.

* * * * *